US007970316B2

(12) United States Patent
Cao et al.

(10) Patent No.: US 7,970,316 B2
(45) Date of Patent: Jun. 28, 2011

(54) METHOD FOR ADVANCING A MEDIA SHEET THROUGH A NIP IN A MEDIA PROCESSING DEVICE

(75) Inventors: Jichang Cao, Lexington, KY (US); Michael David Maul, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 495 days.

(21) Appl. No.: 12/127,897

(22) Filed: May 28, 2008

(65) Prior Publication Data

US 2009/0297194 A1 Dec. 3, 2009

(51) Int. Cl.
*G03G 15/20* (2006.01)

(52) U.S. Cl. ..... 399/122; 399/329; 399/331

(58) Field of Classification Search ..... 399/122, 399/329, 331

See application file for complete search history.

(56) References Cited

U.S. PATENT DOCUMENTS

| | | | | |
|---|---|---|---|---|
| 5,539,855 | A * | 7/1996 | Takahashi et al. | 392/416 |
| 6,253,046 | B1 | 6/2001 | Horrall | |
| 6,801,745 | B1 | 10/2004 | Gogate | |
| 2005/0257822 | A1 * | 11/2005 | Smith et al. | 136/205 |
| 2006/0083528 | A1 * | 4/2006 | Mori et al. | 399/67 |
| 2007/0059013 | A1 * | 3/2007 | Mori et al. | 399/69 |

* cited by examiner

*Primary Examiner* — David M Gray
*Assistant Examiner* — G. M. Hyder

(57) ABSTRACT

A method for processing a media sheet by advancing the media sheet through a nip in a media processing device is disclosed. The nip is capable of being configured by abuttingly coupling a heater device to a pressure roller. A first heater device temperature of the heater device and a pressure roller temperature of the pressure roller are determined. A signal for configuring the nip is generated upon determining the first heater device temperature and the pressure roller temperature. A second heater device temperature of the heater device is determined on generating the signal. A closure of the nip is verified for advancing the media sheet through the nip based on the first heater device temperature, the second heater device temperature and the pressure roller temperature. The media sheet is advanced through the nip on verifying the nip as closed.

20 Claims, 6 Drawing Sheets

METHOD FOR ADVANCING A MEDIA SHEET THROUGH A NIP IN A MEDIA PROCESSING DEVICE

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The disclosure relates generally to media processing devices, and, more particularly, to a nip mechanism for processing a media sheet in a media processing device.

2. Description of the Related Art

Media processing devices are widely used in offices, in homes and in business enterprises for processing media sheets. The processing of a media sheet may include outputting information onto the media sheet. The information transferred onto the media sheet may be adhered onto the media sheet by application of heat and pressure for outputting the information onto the media sheet. A media processing device may be configured to advance the media sheet through a nip configured by a heater device and a pressure roller, for applying the heat and the pressure respectively, for adhering the information onto the media sheet and for outputting the information from the media processing device.

In a media processing device, such as a printer, the media processing device outputs information displayed on a screen of a data processing device onto a media sheet, such as a sheet of paper. Such a media processing device may include an electrophotographic imaging assembly for outputting information onto the media sheet. The electrophotographic imaging assembly typically includes a photoconductive member, a light source, a toner, a media feed assembly and a nip mechanism. The photoconductive member is typically homogenously charged. Based on the information to be output on the media sheet, the light source focuses a light beam onto the photoconductive member to create a charge pattern on the photoconductive member. Toner particles of the toner are electrostatically attracted to the charge pattern to form a latent image which may then be transferred to the media sheet to form an image on the media sheet.

The image formed on the media sheet includes unfused toner particles. The unfused toner particles need to be fused by forcing the unfused toner particles to adhere to the media sheet. The media sheet may be advanced using the media feed assembly to the nip mechanism for fusing the toner particles onto the media sheet. The nip mechanism may typically include a pressure roller and a heater device capable of abuttingly coupling to the pressure roller to form a fuser nip for applying heat and pressure onto the unfused toner particles for permanently fixing the image onto the media sheet. The media sheet is advanced through the fuser nip for fusing the toner particles onto the media sheet. The high temperature melts the toner particles and the pressure forces the toner particles to adhere to the media sheet.

The heater device may include a belt configured to enclose a heating element. A first surface of the belt may be configured to contact the pressure roller to form the nip, such as the fuser nip. The belt is typically coated with a compliant material to increase size of a processing region and to aid in release of the media sheet and the toner particles. The complaint material may become permanently deformed, i.e., compressed, on being subjected to the pressure for prolonged period of time. The deformation of the compliant material may lead to processing defects and torque spikes during processing of the media sheet. To prevent the deformation of the compliant layer, a nip release mechanism is typically included in the media processing device. The nip release mechanism may be configured to engage the nip, i.e., abuttingly couple the heater device to the pressure roller, on generating a signal, such as a signal for processing the media sheet. The nip release mechanism may further be capable of uncoupling the heater device from the pressure roller on completion of the processing of the media sheet. The nip release mechanism is typically configured with a closed-loop control actuated through a feedback loop with a sensor operatively coupled to the nip release mechanism and motion of a motor, such as a fuser motor for controlling the pressure in the nip. Such nip release mechanisms require software sensing and hardware to decrease the pressure in the nip, and as such may be expensive.

Cheaper alternatives, such as an automatic nip release mechanism with no feedback may also be configured for providing ability to reduce the pressure between the heater device and the pressure roller without the use of a sensor feedback loop. The automatic nip release mechanism may utilize a mechanical motion sensing mechanism, such as a swing arm, in conjunction with a sector gear for reducing the pressure in the nip. The automatic nip release mechanism, however, does not include a feedback loop, and as such may fail to detect a failure of the nip to close on generating the signal for engaging the nip. The nip may fail to close due to reasons such as failure of the swing arm to rotate for engaging the nip, poor quality of hardware components used for engaging the nip, wearing of the hardware components, and the like. The failure to detect the closure of the nip prior to performing the processing of the media sheet may be critical for avoiding processing quality problems, poor fuse grade problems, cold offset and the like.

Based on the foregoing, there is a need for processing a media sheet by advancing the media sheet through a nip configured to apply heat and pressure onto the media sheet. Further, there exists a need for verifying a closure of the nip prior to advancing the media sheet through the nip for processing the media sheet. Furthermore, there exists a need for verifying the closure of the nip precluding use additional sensors for reducing cost and mechanical complexity.

SUMMARY OF THE DISCLOSURE

In view of the foregoing disadvantages inherent in the prior art, the general purpose of the present disclosure is to provide a method for processing a media sheet by advancing the media sheet through a nip in a media processing device to include all the advantages of the prior art, and to overcome the drawbacks inherent therein.

Therefore, in one aspect, the present disclosure provides a method for processing a media sheet by advancing the media sheet through a nip in a media processing device. The nip is capable of being configured by abuttingly coupling a heater device to a pressure roller. A first heater device temperature of the heater device and a pressure roller temperature of the pressure roller are determined. A signal for configuring the nip is generated on determining the first heater device temperature and the pressure roller temperature. A second heater device temperature of the heater device is determined on generating the signal. A closure of the nip is verified for advancing the media sheet through the nip based on the first heater device temperature, the second heater device temperature and the pressure roller temperature. The media sheet is advanced through the nip on verifying the nip as closed for processing the media sheet.

In another aspect, the present disclosure provides a method for fusing toner particles onto a media sheet by advancing the media sheet through a fuser nip in a media processing device. The fuser nip is capable of being configured by abuttingly coupling a heater device to a pressure roller. A first heater device temperature of the heater device and a pressure roller temperature of the pressure roller are determined. A signal for configuring the fuser nip is generated on determining the first heater device temperature and the pressure roller temperature. A second heater device temperature of the heater device is determined on generating the signal. A closure of the fuser nip is verified for advancing the media sheet through the fuser nip based on the first heater device temperature, the second heater device temperature and the pressure roller temperature. The media sheet is advanced through the fuser nip upon verifying the fuser nip as closed for fusing toner particles onto the media sheet.

Further, in another embodiment, the present disclosure comprises a computer program product embodied on a computer readable medium for processing a media sheet by advancing the media sheet through a nip in a media processing device. The nip is capable of being configured by abuttingly coupling a heater device to a pressure roller. The computer program product comprises a program module comprising instructions for determining a first heater device temperature of the heater device and a pressure roller temperature of the pressure roller. The instructions include instruction for generating a signal for configuring the nip on determining the first heater device temperature and the pressure roller temperature and determining a second heater device temperature of the heater device on generating the signal. The program module further comprises instructions for verifying a closure of the nip for advancing the media sheet through the nip based on the first heater device temperature, the second heater device temperature and the pressure roller temperature. The instructions further include instructions for advancing the media sheet through the nip on verifying the nip as closed for processing the media sheet.

Advancing the media sheet through the nip processes the media sheet. Verifying the closure of the nip prior to advancing the media sheet through the nip prevents processing quality problems, cold offset and poor fuse grade problems. Further, the first heater device temperature, the second heater device temperature and the pressure roller temperature may be determined using thermistors operatively coupled to a heater device and the pressure roller precludes the need to use additional sensors for verifying the closure of the nip, thus, reducing cost and mechanical complexity for processing the media sheet.

BRIEF DESCRIPTION OF THE DRAWINGS

The above-mentioned and other features and advantages of this present disclosure, and the manner of attaining them, will become more apparent and the present disclosure will be better understood by reference to the following description of embodiments of the disclosure taken in conjunction with the accompanying drawings, wherein.

DETAILED DESCRIPTION

Figure 1A:
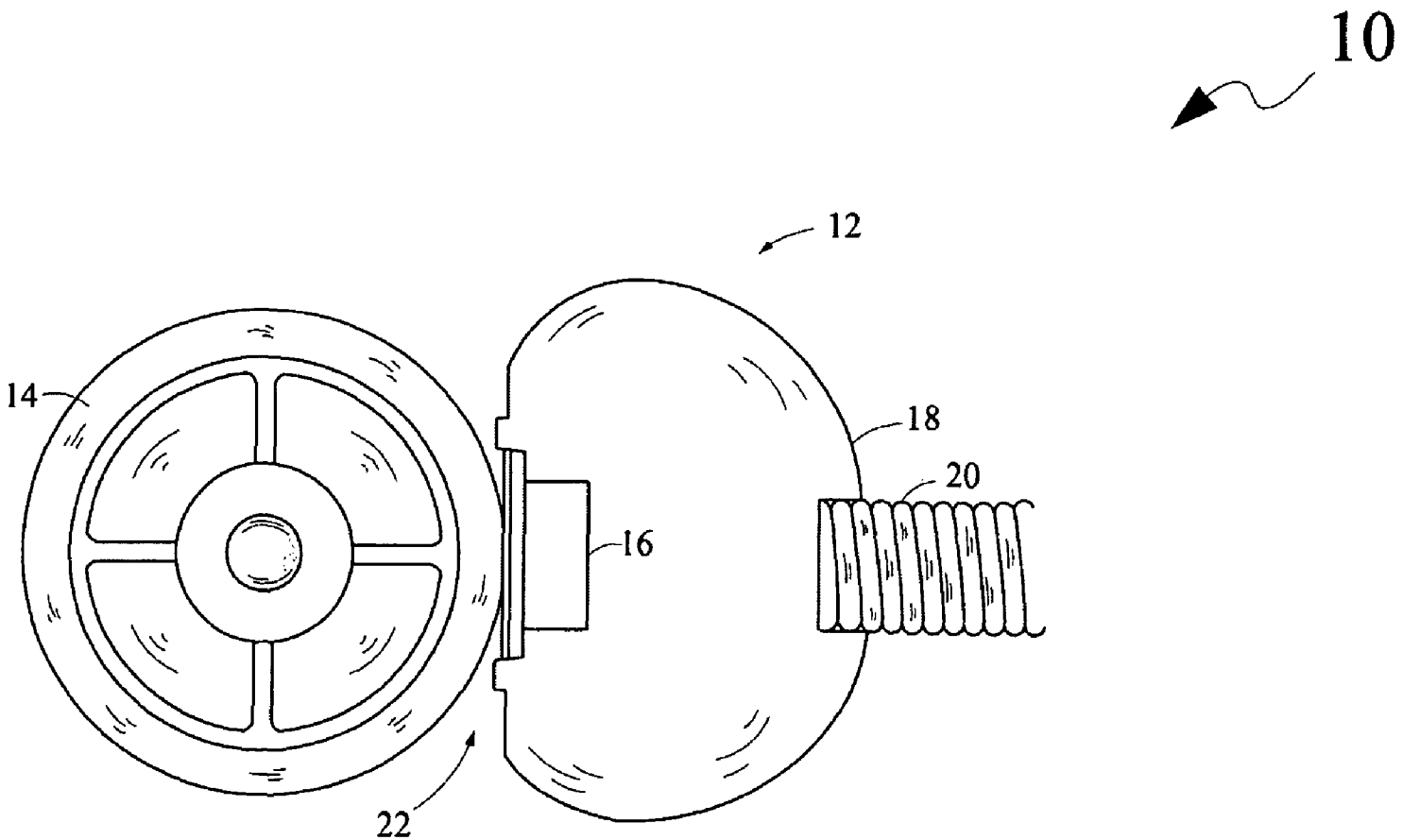
FIG. 1A is a schematic depiction of a front view of a nip mechanism in an engaged state for configuring a nip for processing a media sheet in a media processing device embodying the present disclosure.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the term "coupled," and variations thereof herein are used broadly and encompass direct and indirect couplings. In addition, the term "coupled" and variations thereof are not restricted to physical or mechanical couplings.

In addition, it should be understood that embodiments of the present disclosure include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the present disclosure may be implemented in software. As such, it should be noted that a plurality of hardware and software-based devices, as well as a plurality of different structural components may be utilized to implement the present disclosure. Furthermore, and as described in subsequent paragraphs, the specific mechanical configurations illustrated in the drawings are intended to exemplify embodiments of the present disclosure and that other alternative mechanical configurations are possible.

The present disclosure provides a method and a computer program product for processing a media sheet by advancing the media sheet through a nip in a media processing device. The nip is capable of being configured by abuttingly coupling a heater device to a pressure roller. A first heater device temperature of the heater device and a pressure roller temperature of the pressure roller are determined. A signal for configuring the nip is generated upon determining the first heater device temperature and the pressure roller temperature. A second heater device temperature of the heater device is determined on generating the signal. A closure of the nip is verified for advancing the media sheet through the nip based on the first heater device temperature, the second heater device temperature and the pressure roller temperature. The media sheet is advanced through the nip upon verifying the nip as closed for processing the media sheet.

Figure 1B:
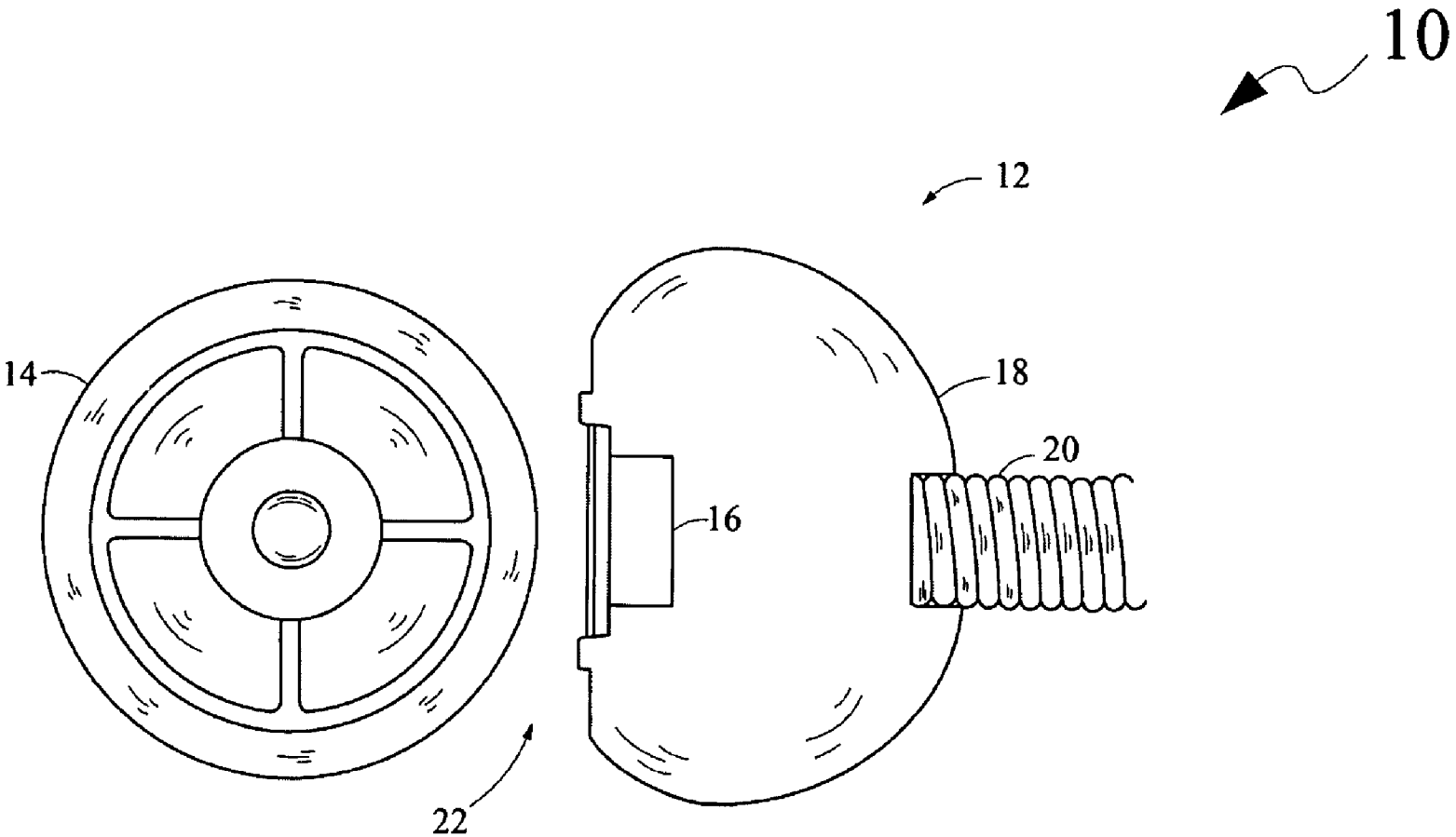
FIG. 1B is a schematic depiction of a front view of the nip mechanism in a disengaged state embodying the present disclosure.

Referring now to FIGS. 1A and 1B, there is shown a schematic depiction of a front view of a nip mechanism 10 of a media processing device (not shown), in an engaged state and a disengaged state respectively. Nip mechanism 10 includes a heater device 12 and a pressure roller 14. FIG. 1A depicts nip mechanism 10 in the engaged state, i.e., heater device 12 is abuttingly coupled to pressure roller 14. FIG. 1B depicts nip mechanism 10 in the disengaged state, i.e., heater device 12 and pressure roller 14 are spaced apart from each other. Heater device 12 includes a heating element 16 and a belt 18. Belt 18 is disposed forming an inner loop for enclosing heating element 16. A first surface (not shown) of belt 18 may make contact with pressure roller 14 on abuttingly coupling heater device 12 to pressure roller 14. Belt 18 may be composed of one or more elastomeric layers or any such compliant material enabling ease of release of a media sheet from nip mechanism 10. Examples of the media sheet may include a sheet of paper, a card stock, an envelope, a transparency and the like.

An engaging mechanism 20, in form of a spring contact, is depicted in FIGS. 1A and 1B for abuttingly coupling heater device 12 to pressure roller 14. It will be evident to those skilled in the art that engaging mechanism 20 may further be coupled to a suitable actuating means (not shown), such as a swing arm, for actuating the movement of engaging mechanism 20 for abuttingly coupling heater device 12 to pressure roller 14 and de-coupling heater device 12 from pressure roller 14. Further, it will be obvious to those skilled in the art that engaging mechanism 20 including the spring contact is depicted for purposes of the description, and that engaging mechanism 20 may include any suitable coupling means for coupling and de-coupling heater device 12 and pressure roller 14. Moreover, engaging mechanism 20 is depicted to be adapted to facilitate movement of heater device 12 for abuttingly coupling heater device 12 to pressure roller 14, however, it will be evident to those skilled in the art that engaging mechanism 20 may be operatively disposed to facilitate movement of pressure roller 14 to abuttingly couple to heater device 12.

FIG. 1A depicts the engaged state of nip mechanism 10, i.e., heater device 12 abuttingly coupled to pressure roller 14 to configure a nip 22. A signal may be generated for actuating engaging mechanism 20 for configuring nip 22 by abuttingly coupling heater device 12 to pressure roller 14. The signal may be generated on switching the media processing device to an operational mode from a standby mode or from a power-saving mode. On generation of the signal, the actuating means may actuate engaging mechanism 20 to abuttingly couple heater device 12 to pressure roller 14 for configuring nip 22 for processing a media sheet. On verifying a closure of nip 22, the media sheet may be advanced through nip 22 for processing the media sheet.

In one embodiment of the present disclosure, the media processing device is a printing device and processing the media sheet by nip mechanism 10 in the printing device includes fusing toner particles onto the media sheet by advancing the media sheet through nip 22, referred to as a fuser nip for the purposes of the embodiment. The fuser nip configured by abuttingly coupling heater device 12 to pressure roller 14 may be used for fusing the toner particles. Unfused toner particles disposed on the media sheet may be adhered to the media sheet by advancing the media sheet through the fuser nip. It will be evident to those skilled in the art that the printing device may include a media entry guide for facilitating advancement of the media sheet towards the fuser nip. Moreover, the media sheet may be guided towards the fuser nip, such that, an image formed by the unfused toner particles on the media sheet is adjacent to heater device 12 during advancement through the fuser nip. Heater device 12 of the fuser nip may melt the unfused toner particles and pressure roller 14 of the fuser nip may apply pressure onto the melted unfused toner particles for adhering the toner particles onto the media sheet for fusing the toner particles onto the media sheet, thereby processing the media sheet.

On completion of the processing of the media sheet, the actuating mechanism may generate a signal for actuating engaging mechanism 20 to de-couple heater device 12 from pressure roller 14 to configure the disengaged state of nip mechanism 10. For a subsequent processing of the media sheet, the engaged state of nip mechanism 10 may be configured for processing the media sheet. A method for processing the media sheet is explained in detail in conjunction with FIG. 2.

Figure 2:
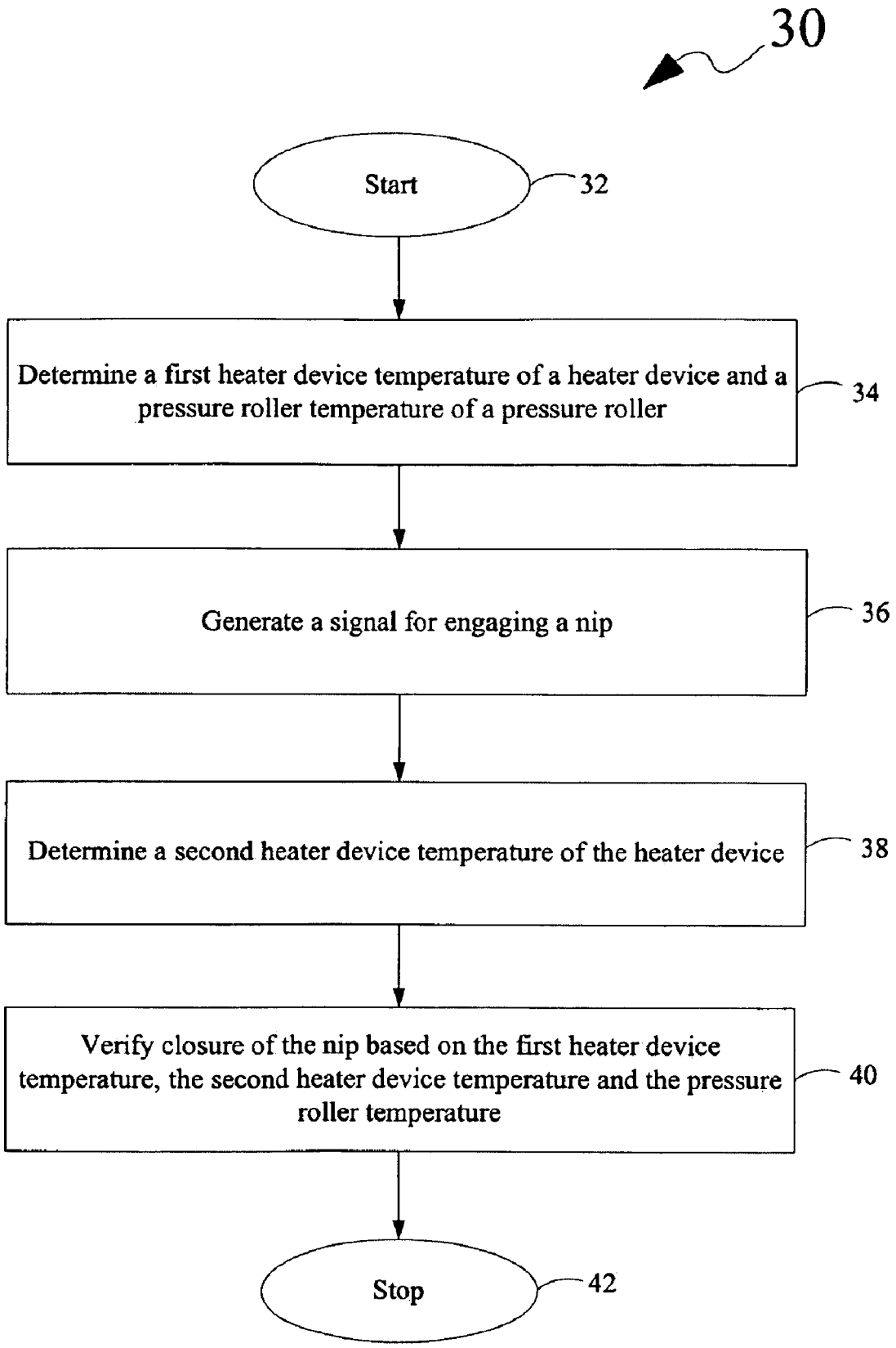
FIG. 2 is a flow diagram illustrating a method for processing the media sheet in the media processing device embodying the present disclosure.

FIG. 2 is a flow diagram depicting a method 30 for processing the media sheet by advancing the media sheet through nip 22 embodying the present disclosure. Method 30 starts at 32. At 32, nip mechanism 10 is configured in a disengaged state. At 34, a first heater device temperature of heater device 12, and, a pressure roller temperature of the pressure roller 14 are determined. The first heater device temperature and the pressure roller temperature are determined prior to configuring nip 22. In one embodiment of the present disclosure, each of heater device 12 and pressure roller 14 may be operatively coupled to a thermistor (not shown) for determining, i.e., sensing the first heater device temperature of heater device 12 and the pressure roller temperature of pressure roller 14 respectively. At 36, a signal is generated for configuring nip 22 for abuttingly coupling heater device 12 to pressure roller 14. At 38, a second heater device temperature of heater device 12 is determined. The second heater device temperature may be determined, i.e., sensed on configuring nip 22. At 40, a closure of nip 22 is determined based on the first heater device temperature, second heater device temperature and the pressure roller temperature. The method ends at 42. At 42, the media sheet is advanced through nip 22 on verifying nip 22 as closed for processing the media sheet.

It will be evident to those skilled in the art that verifying the closure of nip 22 includes verifying one of whether nip 22 is closed, i.e., heater device 12 is abuttingly coupled to pressure roller 14, and, whether nip 22 is open, i.e., failure of heater device 12 to abuttingly couple to pressure roller 14 for configuring nip 22. Further, it will be obvious to a person skilled in the art that verifying the closure of nip 22 prior to advancing the media sheet through nip 22 may preclude processing quality problems, fuse grade problems, cold offset and the like.

In one embodiment of the present disclosure, the media sheet is advanced through nip 22 on verifying nip 22 as closed. In another embodiment of the present disclosure, an error message is generated on verifying nip 22 as open. Prior to generating the error message, method 30 from 32 to 40 may be repeated a predefined number of times for confirming nip 22 as open.

In one embodiment of the present disclosure, the closure of nip 22 is verified based on a temperature difference between the first heater device temperature and the second heater device temperature, and, the pressure roller temperature. In an exemplary embodiment of the present disclosure, nip 22 is verified as closed based on one of whether the pressure roller temperature is less than or equal to a first threshold value and the temperature difference is greater than a second threshold value, and, whether the pressure roller temperature is greater than the first threshold value and the temperature difference is greater than a third threshold value, is satisfied. Further, nip 22 is verified as open based on one of whether the pressure roller temperature is less than or equal to the first threshold value and the temperature difference is less than the second threshold value and whether the pressure roller temperature is greater than the first threshold value and the temperature difference is less than the third threshold value, is satisfied.

The temperature difference between the first heater device temperature and the second heater device temperature may be based on the pressure roller temperature. For pressure roller 14 at a high temperature, i.e., a high value of the pressure roller temperature, the temperature difference may be substantially lesser than as compared to the temperature difference when pressure roller 14 is at a lower temperature. The temperature difference may be substantially higher when pressure roller 14 is at a lower temperature on account of sudden increase in thermal load resulting from abuttingly coupling heater device 12 to pressure roller 14. Thus, for a sensed pressure roller temperature, a difference in a sensed heater device temperature prior to configuring nip 22, i.e., the first heater device temperature, and a sensed heater device temperature on generation of command for configuring nip 22, i.e., the second heater device temperature, may provide indication of existence of pressure in nip 22, thereby verifying the closure of nip 22.

In one embodiment of the present disclosure, the second heater device temperature is determined on occurrence of a predefined time interval from determining the first heater device temperature. In an exemplary embodiment of the present disclosure, the predefined time interval may be 1.2 seconds. It will be evident to those skilled in the art that the second heater device temperature may be determined on occurrence of the predefined time interval from determining the pressure roller temperature instead of the first heater device temperature.

In one embodiment of the present disclosure, the media processing device is switched to an operational mode, such as the operational mode explained in conjunction with FIGS. 1A and 1B, prior to determining the first heater device temperature. For a media processing device, such as a printing device, the operational mode may be a print mode for processing, i.e., printing onto the media sheet.

On verification of the closure of nip 22, the media sheet may be advanced through nip 22 for processing the media sheet. An exemplary method for fusing toner particles onto a media sheet, i.e., processing of the media sheet, by advancing the media sheet through a fuser nip, such as nip 22, is explained in conjunction with FIG. 3.

Figure 3:
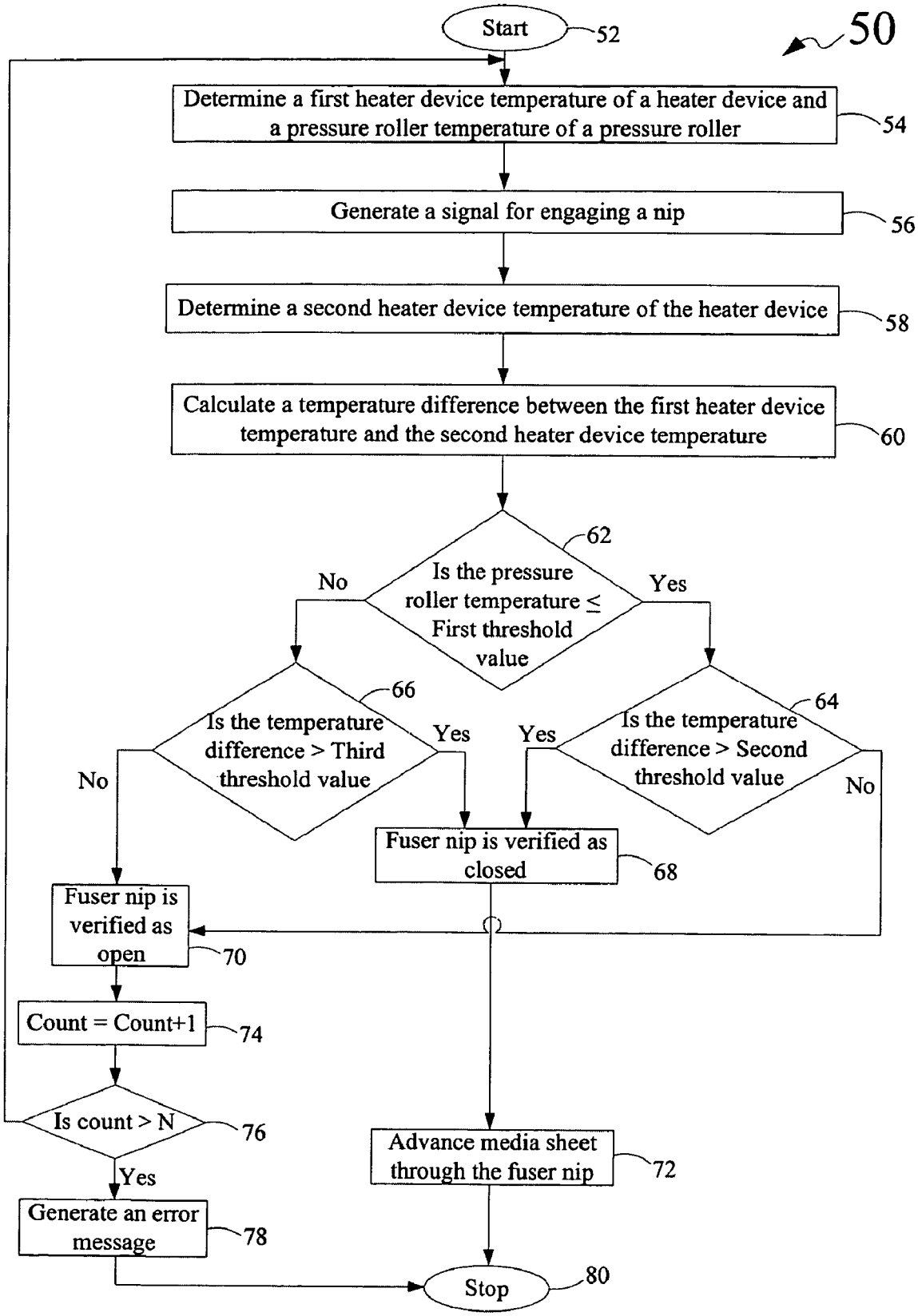
FIG. 3 is a flow diagram illustrating a method for fusing toner particles onto a media sheet in the media processing device embodying the present disclosure.

FIG. 3 is a flow diagram illustrating a method 50 for fusing toner particles onto the media sheet by advancing the media sheet through a fuser nip in a media processing device embodying the present disclosure. As explained in conjunction with FIGS. 1A and 1B, the fuser nip, such as nip 22, is configured by abuttingly coupling a heater device, such as heater device 12, to a pressure roller, such as pressure roller 14. Method 50 starts at 52. At 52, fuser nip is open, i.e., the heater device and the pressure roller are spaced apart from each other. At 54, a first heater device temperature of the heater device, and, a pressure roller temperature of the pressure roller are determined. The first heater device temperature and the pressure roller temperature are determined prior to configuring the fuser nip. As explained in conjunction with FIG. 2, each of the heater device and the pressure roller may be operatively coupled to a thermistor (not shown) for determining, i.e., sensing the first heater device temperature and the pressure roller temperature. At 56, a signal is generated for configuring the fuser nip, i.e., abuttingly coupling the heater device to the pressure roller. As explained in conjunction with FIGS. 1A and 1B, the signal may be generated on switching the media processing device to an operational mode, such as a print mode, from the standby or the power-saving mode for processing the media sheet. At 58, a second heater device temperature of the heater device is determined. At 60, a temperature difference between the first heater device temperature and the second heater device temperature is calculated.

At 62, a value of the pressure roller temperature is compared with a first threshold value. If the pressure roller temperature is less than or equal to the first threshold value then 64 is performed. If the pressure roller temperature is greater than the first threshold value then 66 is performed. At 64, the temperature difference is compared with the second threshold value. If the temperature difference is greater than the second threshold value then 68 is performed. At 68, the fuser nip is verified as closed. If the temperature difference is less than or equal to the second threshold value then 70 is performed. At 70, the fuser nip is verified as open. At 66, the temperature difference is compared with a third threshold value. If the temperature difference is greater than the third threshold value then 68 is performed, i.e., the fuser nip is verified as closed. If the temperature difference is less than or equal to the third threshold value than 70 is performed, i.e., the fuser nip is verified as open. If the fuser nip is verified as closed, then 72 is performed. At 72, the media sheet is advanced through the fuser nip for fusing the toner particles onto the media sheet. If the fuser nip is verified as open, then 74 is performed. At 74, a count, initially set to zero, is incremented by one. At 76, the count is compared with N, i.e., a predefined number of trials for verifying the closure of the fuser nip. If the count is less than or equal to N then 54 onwards are repeated till either the fuser nip is verified as closed or the count exceeds N. If the count exceeds N then 78 is performed. At 78, an error message to be displayed on a front panel of the media processing device is generated. Method 50 ends at 80.

Thus, the closure of the fuser nip is verified prior to advancing the media sheet through the fuser nip for fusing the toner particles onto the media sheet. As explained in conjunction with FIG. 2, for a sensed a pressure roller temperature, a difference in a sensed heater device temperature prior to configuring the fuser nip, i.e., the first heater device temperature, and a sensed heater device temperature on generation of command for configuring the fuser nip, i.e., the second heater device temperature, may provide indication of existence of pressure in the fuser nip, thereby verifying the closure of fuser nip. It will be evident to those skilled in the art that method 50 including the verification of the closure of the fuser nip based on the temperature difference and the pressure roller temperature is depicted for exemplary purposes, and, that the verification of the closure of the fuser nip may be based on at least one of the sensed first heater device temperature, the sensed second heater device temperature and the sensed pressure roller temperature.

In an exemplary embodiment of the present disclosure, values of the first threshold value, the second threshold value and the third threshold value may be 100 degrees Celsius (C), 12 degrees C and 7 degrees C. In one embodiment of the present disclosure, the second heater device temperature is determined on occurrence a predefined time interval from determining the first heater device temperature and /or the pressure roller temperature. In an exemplary embodiment of the present disclosure, the predefined time interval is 1.2 seconds. The verification of the closure of the fuser nip based on the difference in the sensed heater device temperature, and, the pressure roller temperature is further explained in conjunction with FIGS. 4A and 4B.

Figure 4A:
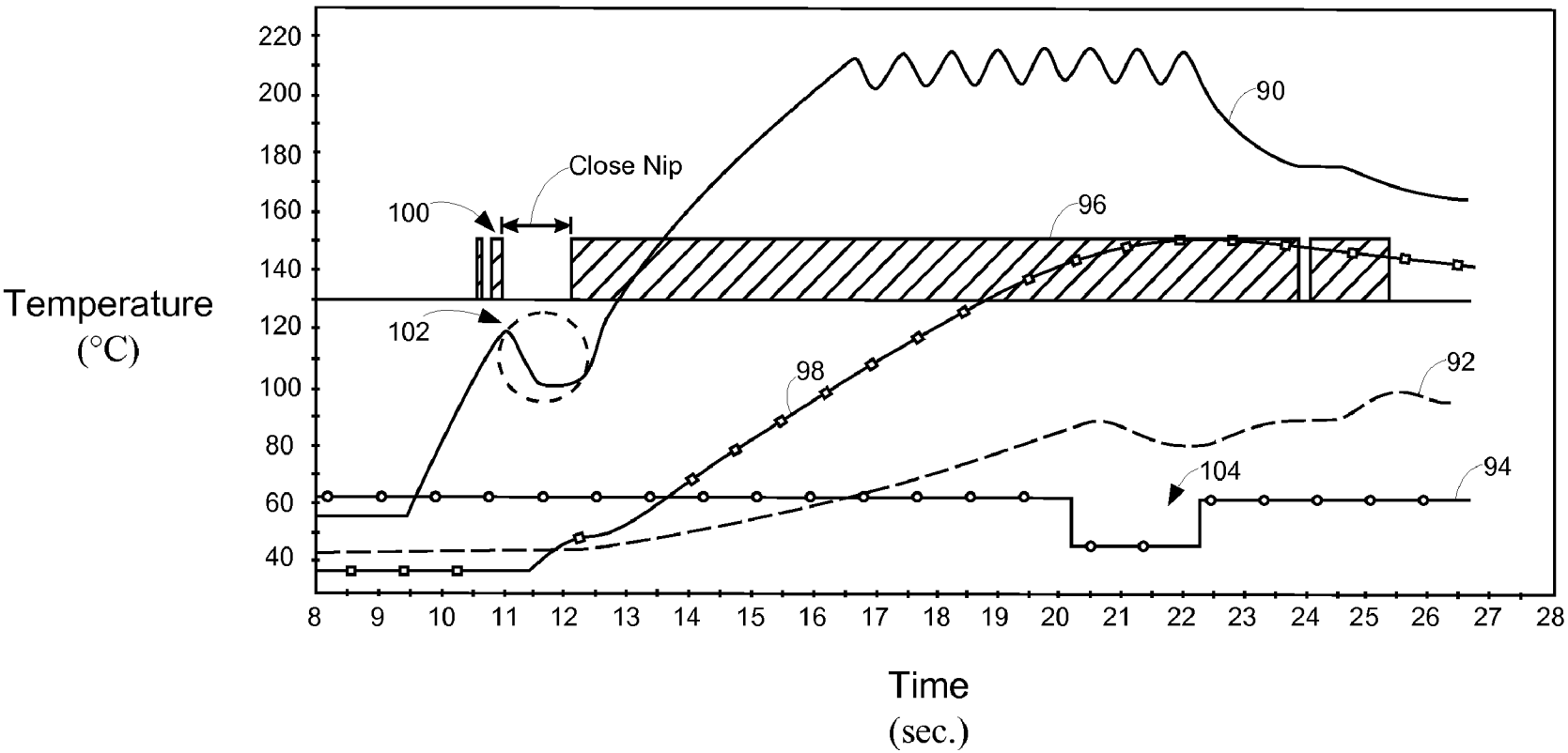
FIG. 4A is a schematic depiction of a variation of a heater device temperature and a pressure roller temperature recorded in an exemplary environment during processing of the media sheet in the media processing device embodying the present disclosure.

FIG. 4A is a schematic depiction of a variation of a heater device temperature and a pressure roller temperature recorded in an exemplary environment during a closure of the fuser nip embodying the present disclosure. FIG. 4A depicts a plot 90 depicting variation in heater device temperature, a plot 92 depicting variation in pressure roller temperature, a plot 94 depicting a variation in a media sheet exit signal, a plot 96 depicting a fuser motor command signal and a plot 98 depicting variation in belt temperature of a belt, such as belt 18. On switching to the operational mode, such as the print mode, from the standby mode or the power-saving mode, the media sheet is advanced through various sections of the media processing device such as a media input tray, a drive apparatus, a printing region (as depicted by the media sheet signal) and the like. On completion of printing onto the media sheet, the media sheet including the unfused toner particles may be advanced towards the fuser nip using the media entry guide (explained in conjunction with FIGS. 1A and 1B) for fusing the unfused toner particles onto the media sheet. On completion of the printing operation, a fuser motor command signal may be generated for configuring the fuser nip, i.e., abuttingly coupling the heater device to the pressure roller. The generation of the fuser motor command signal for configuring the fuser nip is depicted by a spike 100 in the fuser motor command signal. On generation of the fuser motor command signal for configuring the fuser nip, an engaging mechanism, such as engaging mechanism 20, may be actuated by the actuating mechanism in the media processing device for abuttingly coupling the heater device to the pressure roller.

On abuttingly coupling the heater device to the pressure roller, the pressure roller is forced to quickly contact the heater device and a belt, such as belt 18, configuring an inner loop for enclosing the heating element, such as heating element 16, of the heater device, thereby adding a considerable thermal load onto the belt and the heater device. The heater device temperature drops significantly within a very short time on coming in contact with the pressure roller, as depicted by a drop 102 in the heater device temperature. On configuring the fuser nip, the heater device temperature gradually recovers and increases to a pre-defined target temperature. As evident from plots 92 and 98, the belt temperature and the pressure roller temperature also increase with the increase in the heater device temperature to assume corresponding predefined target temperatures. On completion of the fusing of the toner particles onto the media sheet, the media sheet may be exited from the media processing device, as indicated by a variation 104 in plot 94. As evident from plot 96, the fuser motor command signal is generated till the processing of the media sheet is completed and may then direct the engaging mechanism to retain the fuser nip in the configured condition or may direct the engaging mechanism to de-couple the heater device from the pressure roller depending on a time duration for a subsequent print operation.

Drop 102 in the heater device temperature, also referred to as a temperature droop, is dependent on the pressure roller temperature. In FIG. 4A, the pressure roller is at a lower temperature and correspondingly the temperature droop is greater than 20 degrees C. The temperature droop is relatively lower when the pressure roller is at a high temperature. The variation in the temperature droop when the pressure roller is at a high temperature is depicted in FIG. 4B.

Figure 4B:
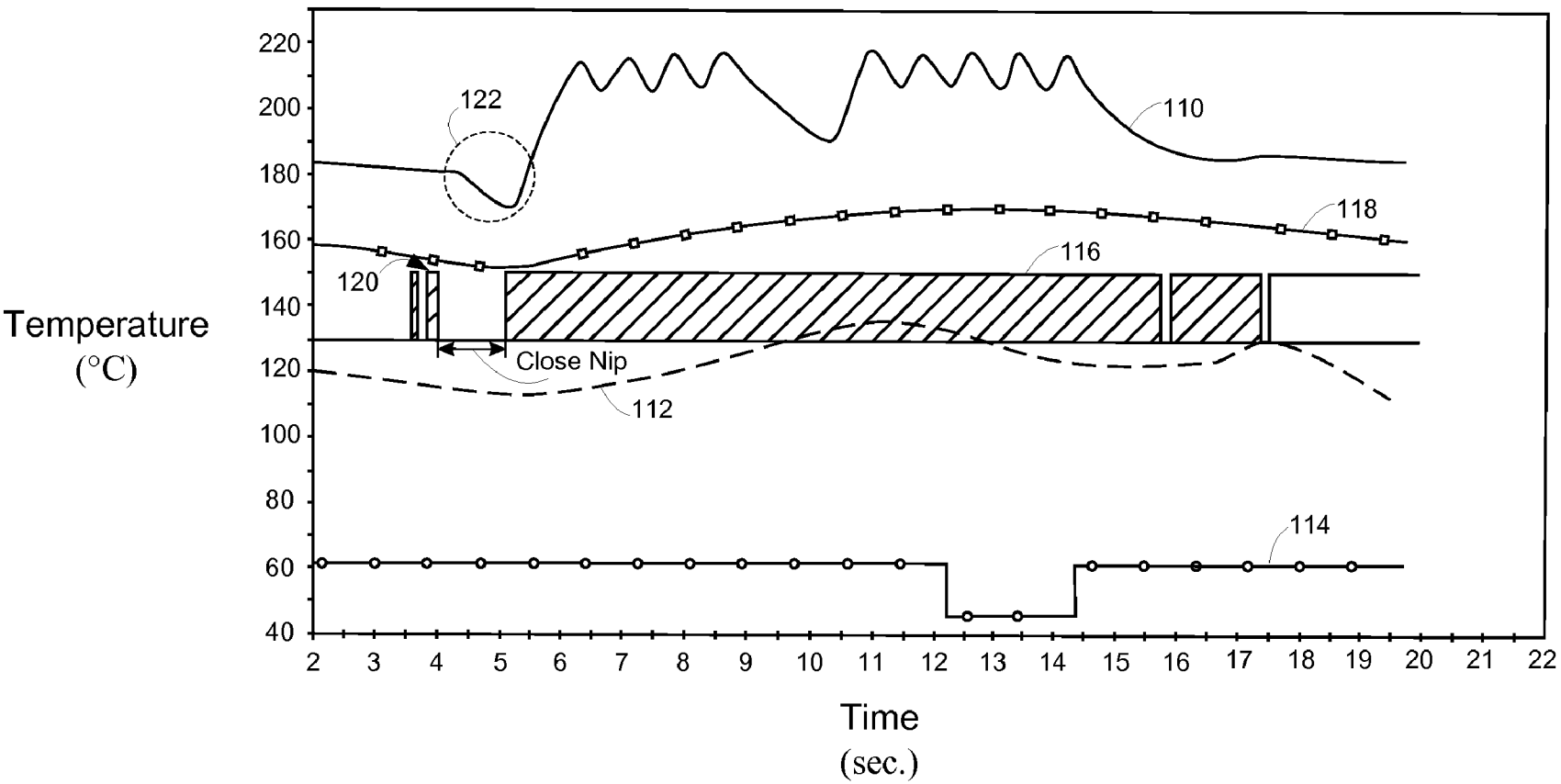
FIG. 4B is a schematic depiction of a variation in the heater device temperature when the pressure roller is at a high temperature, recorded in an exemplary environment during processing of the media sheet in the media processing device embodying the present disclosure.

FIG. 4B is a schematic depiction of a variation in the heater device temperature when the pressure roller is at a high temperature, for fusing the toner particles onto the media sheet in the media processing device, embodying the present disclosure. FIG. 4B depicts a plot 110 depicting variation in the heater device temperature, a plot 112 depicting variation in the pressure roller temperature, a plot 114 depicting a variation in the media sheet exit signal, a plot 116 depicting a fuser motor command signal and a plot 118 depicting variation in the belt temperature. As explained in conjunction with FIG. 4A, the heater device temperature is dependent on the pressure roller temperature. In FIG. 4B, the pressure roller is at a relatively high temperature. Hence, when the pressure roller is forced to contact the heater device on generation of a signal, depicted as spike 120 in plot 116, for configuring the fuser nip, the resulting thermal load on the heater device is lesser compared to the thermal load when the pressure roller is at a lower temperature. Thus, the temperature droop, depicted by drop 122 in plot 110, is below 10 degrees and is relatively lesser as compared to the temperature droop when the pressure roller is at a lower temperature.

As explained in conjunction with FIGS. 2 and 3, the pressure roller temperature and the corresponding the temperature droop, i.e., the temperature difference between the heater device temperature prior to engaging the fuser nip and the heater device temperature on engaging the fuser nip may be used to verify the closure of the fuser nip. In an exemplary embodiment of the present disclosure, for a pressure roller temperature lesser than or equal to 100 degrees C. if the temperature droop, i.e., the temperature difference between the first heater device temperature and the second heater device temperature, is greater than 12 degrees C. then the fuser nip is verified as closed. Further, for the pressure roller temperature less than or equal to 100 degrees C if the temperature drop, is less than the 12 degrees C. then the fuser nip is verified as open.

In another exemplary embodiment of the present disclosure, for the pressure roller temperature greater than 100 degrees C if the temperature drop is greater than 7 degrees C than the fuser nip is verified as closed. Furthermore, for the pressure roller temperature greater than 100 degrees C if the temperature drop is less than or equal to 7 degrees C. then the fuser nip is verified as open.

Thus, the closure of a nip, such as nip 22 and the fuser nip, may be based on the temperature difference, i.e., based on the first heater device temperature and the second heater device temperature, and, the pressure roller temperature. Verifying the closure of the nip prior to advancing the media sheet through the nip prevents print quality problems and poor fuse grade problems. Further, the first heater device temperature, the second heater device temperature and the pressure roller temperature may be determined using thermistors communicably coupled to the heater device and the pressure roller. Verifying the closure of the nip for advancing the media sheet through the fuser nip based on the first heater device temperature, the second heater device temperature and the pressure roller temperature, thus may be performed in a simple manner precluding the need to use additional sensors thus reducing cost and mechanical complexity. Further, the closure of the nip may be fairly verified precluding the need of any sensor feedback loop.

As described above, the embodiments of the present disclosure may be embodied in the form of a computer program product for processing a media sheet in a media processing device, such as the media processing device explained in conjunction with FIGS. 1A, 1B, 2 and 3. Embodiments of the present disclosure may also be embodied in the form of program module containing instructions embodied in tangible media, such as floppy diskettes, CD-ROMs, hard drives, or any other computer-readable storage medium, wherein, when the program module is loaded into and executed by a computer, the computer becomes an apparatus for practicing the present disclosure. The program module includes instructions for determining the first heater device temperature of the heater device and the pressure roller temperature of the pressure roller. The instructions include instruction for generating a signal for configuring the nip on determining the first heater device temperature and the pressure roller temperature and determining a second heater device temperature of the heater device on generating the signal. The program module further comprises instructions for verifying a closure of the nip for advancing the media sheet through the nip based on the first heater device temperature, the second heater device temperature and the pressure roller temperature.

The program module also includes instructions for advancing the media sheet through the nip for processing the media sheet on verifying the nip as closed, and, instructions for generating an error message on verifying the nip as open. The instructions for verifying the closure of the nip comprises instructions for verifying the closure of the nip based on a temperature difference between the first heater device temperature and the second heater device temperature, and, the pressure roller temperature. The instructions for verifying the closure of the nip comprises instructions for verifying the nip as closed based on one of whether the pressure roller temperature is less than or equal to a first threshold value and the temperature difference is greater than a second threshold value, and, whether the pressure roller temperature is greater than the first threshold value and the temperature difference is greater than a third threshold value, is satisfied. The instructions for verifying the closure of the nip further comprises instructions for verifying the nip as open based on one of whether the pressure roller temperature is less than or equal to the first threshold value and the temperature difference is less than the second threshold value, and, whether the pressure roller temperature is greater than the first threshold value and the temperature difference is less than the third threshold value, is satisfied.

It will be apparent to a person skilled in the art that the present disclosure as described above, may be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an apparatus for practicing the present disclosure. When implemented on a general-purpose microprocessor, the computer program code segments configure the microprocessor to create specific logic circuits.

The foregoing description of several methods and an embodiment of the present disclosure have been presented for purposes of illustration. It is not intended to be exhaustive or to limit the present disclosure to the precise steps and/or forms disclosed, and obviously many modifications and variations are possible in light of the above description. It is intended that the scope of the present disclosure be defined by the claims appended hereto.

What is claimed is:

1. A method for processing a media sheet by advancing the media sheet through a nip in a media processing device, the nip capable of being configured by abuttingly coupling a heater device to a pressure roller, the method comprising:

determining a first value of the heater device temperature of the heater device and a pressure roller temperature value of the pressure roller;

generating a signal for configuring the nip, wherein the signal is generated upon determining the first value of the heater device temperature and the pressure roller temperature value;

determining a second value of the heater device temperature of the heater device on generating the signal; and verifying a closure of the nip for advancing the media sheet through the nip based on the first value of the heater device temperature, the second value of the heater device temperature and the pressure roller temperature value.

2. The method of claim 1 further comprising advancing the media sheet through the nip for processing the media sheet upon verifying the nip as closed.

3. The method of claim 1 further comprising generating an error message upon the verifying indicating the nip as failing to close.

4. The method of claim 1 further comprising switching the media processing device to an operational mode prior to determining the first value of the heater device temperature.

5. The method of claim 1 wherein the second value of the heater device temperature is determined on occurrence of a predefined time interval after determining the first value of the heater device temperature.

6. A method of claim 1 wherein the closure of the nip is verified based on a temperature difference between the first value of the heater device temperature and the second value of the heater device temperature, and, the pressure roller temperature value.

7. The method of claim 6 wherein the nip is verified as closed based on one of whether the pressure roller temperature value is less than or equal to a first threshold value and the temperature difference is greater than a second threshold value, and, whether the pressure roller temperature value is greater than the first threshold value and the temperature difference is greater than a third threshold value, is satisfied.

8. The method of claim 7 wherein the nip is verified as open based on one of whether the pressure roller temperature value is less than or equal to the first threshold value and the temperature difference is less than the second threshold value and whether the pressure roller temperature value is greater than the first threshold value and the temperature difference is less than the third threshold value, is satisfied.

9. A method for fusing toner particles onto a media sheet by advancing the media sheet through a fuser nip in a media processing device, the fuser nip capable of being configured by abuttingly coupling a heater device to a pressure roller, the method comprising:

determining a first value of the heater device temperature of the heater device and a pressure roller temperature value of the pressure roller;

generating a signal for configuring the fuser nip, wherein the signal is generated upon determining the first value of the heater device temperature and the pressure roller temperature value;

determining a second value of the heater device temperature of the heater device on generating the signal; and verifying a closure of the fuser nip for advancing the media sheet through the fuser nip based on the first value of the heater device temperature, the second value of the heater device temperature and the pressure roller temperature value.

10. The method of claim 9 further comprising advancing the media sheet through the fuser nip for fusing the toner particles onto the media sheet upon verifying the fuser nip as closed.

11. The method of claim 9 further comprising generating an error message upon the verifying indicating the fuser nip as failing to close.

12. A method of claim 9 wherein the closure of the fuser nip is verified based on a temperature difference between the first value of the heater device temperature and the second value of the heater device temperature, and, the pressure roller temperature value.

13. The method of claim 12 wherein the fuser nip is verified as closed based on one of whether the pressure roller temperature value is less than or equal to a first threshold value and the temperature difference is greater than a second threshold value and whether the pressure roller temperature value is greater than the first threshold value and the temperature difference is greater than a third threshold value, is satisfied.

14. The method of claim 13 wherein the fuser nip is verified as open based on one of whether the pressure roller temperature value is less than or equal to the first threshold value and the temperature difference is less than the second threshold value, and, whether the pressure roller temperature value is greater than the first threshold value and the temperature difference is less than the third threshold value, is satisfied.

15. A computer program product embodied on a non-transitory computer readable medium for processing a media sheet by advancing the media sheet through a nip in a media processing device, the nip capable of being configured by abuttingly coupling a heater device to a pressure roller, the computer program product comprising a program module having instructions for:

determining a first value of the heater device temperature of the heater device and a pressure roller temperature value of the pressure roller;

generating a signal for configuring the nip, wherein the signal is generated based upon determining the first value of the heater device temperature and the pressure roller temperature value;

determining a second value of the heater device temperature of the heater device on generating the signal; and verifying a closure of the nip for advancing the media sheet through the nip based on the first value of the heater device temperature, the second value of the heater device temperature and the pressure roller temperature value.

16. The computer program product according to claim 15 wherein the program module further comprises instructions for advancing the media sheet through the nip for processing the media sheet upon verifying the nip as closed.

17. The computer program product according to claim 15 wherein the program module further comprises instructions for generating an error message upon the verifying indicating the nip as failing to close.

18. The computer program product according to claim 15 wherein the instructions for verifying the closure of the nip comprises instructions for verifying the closure of the nip based on a temperature difference between the first value of the heater device temperature and the second value of the heater device temperature, and, the pressure roller temperature value.

19. The computer program product according to claim 18 wherein the instructions for verifying the closure of the nip comprises instructions for verifying the nip as closed based on one of whether the pressure roller temperature value is less than or equal to a first threshold value and the temperature difference is greater than a second threshold value, and, whether the pressure roller temperature value is greater than the first threshold value and the temperature difference is greater than a third threshold value, is satisfied.

20. The computer program product according to claim 19 wherein the instructions for verifying the closure of the nip comprises instructions for verifying the nip as open based on one of whether the pressure roller temperature value is less than or equal to the first threshold value and the temperature difference is less than the second threshold value, and, whether the pressure roller temperature value is greater than the first threshold value and the temperature difference is less than the third threshold value, is satisfied.

* * * * *